US008834061B2

(12) United States Patent
White

(10) Patent No.: US 8,834,061 B2
(45) Date of Patent: Sep. 16, 2014

(54) WATER PERMEABLE TRAFFIC BEARING SYSTEM, METHOD AND DRAINAGE JOINT FOR USE WITH SAME

(71) Applicant: Bryan White, Camby, IN (US)

(72) Inventor: Bryan White, Camby, IN (US)

(73) Assignee: Bryan White, Camby, IN (US)

( * ) Notice: Subject to any disclaimer, the term of this patent is extended or adjusted under 35 U.S.C. 154(b) by 0 days.

(21) Appl. No.: 13/896,449

(22) Filed: May 17, 2013

(65) Prior Publication Data

US 2013/0243525 A1 Sep. 19, 2013

Related U.S. Application Data

(62) Division of application No. 13/206,585, filed on Aug. 10, 2011, now Pat. No. 8,469,625.

(60) Provisional application No. 61/480,025, filed on Apr. 28, 2011, provisional application No. 61/372,239, filed on Aug. 10, 2010.

(51) Int. Cl.
*E01C 7/32* (2006.01)

(52) U.S. Cl.
USPC ..... 404/4; 404/2; 404/75; 210/164

(58) Field of Classification Search
USPC ..... 210/154, 164, 165, 170.03; 404/2, 3, 4, 404/72, 75; 405/36
See application file for complete search history.

(56) References Cited

U.S. PATENT DOCUMENTS 838,450 A * 12/1906 Redemeyer ..... 404/4
2,431,385 A 11/1947 Fischer
3,876,322 A 4/1975 Deason
4,061,272 A 12/1977 Winston
4,365,911 A 12/1982 Rossberg
4,490,067 A 12/1984 Dahowski
4,648,737 A 3/1987 Lake, Jr. et al.
4,717,284 A * 1/1988 Gress ..... 405/50
4,834,576 A 5/1989 Argento
4,898,494 A * 2/1990 Ellis ..... 404/2
5,026,202 A 6/1991 Thomann
5,130,016 A 7/1992 Gavin
5,282,691 A * 2/1994 McIntosh et al. ..... 404/3
5,326,189 A 7/1994 Beamer
5,326,190 A 7/1994 Beamer
5,375,940 A 12/1994 Kobayashi
5,380,121 A 1/1995 Schluter (Continued)

*Primary Examiner* — Gary Hartmann

(57) ABSTRACT

Making a water permeable traffic bearing system includes preparing a compound water permeable base in contact with a native substrate, and installing a drainage system having a plurality of elongate drainage joints over the prepared water permeable base. Each of the drainage joints defines a plurality of vertical drainage conduits opening at upper and lower sides and in fluid communication with a storage volume defined by the water permeable base. Making the water permeable traffic bearing system further includes forming a segmental mat having a plurality of water impermeable surface pads abutting the plurality of drainage joints, at least in part by filling voids extending horizontally between the drainage joints with a curable paving material, and curing the paving material within the voids, in contact with each of the water permeable base and the drainage joints. Installing the drainage system further includes tuning precipitation handling of the traffic bearing system, at least in part by setting a spacing and a number of the drainage joints responsive to, a water through-put factor of the traffic bearing system and a structural factor of the segmental mat. The drainage joints may have upwardly and downwardly oriented legs joined via a bridge in an H-configuration.

4 Claims, 6 Drawing Sheets

(56) References Cited

U.S. PATENT DOCUMENTS

| | | | | |
|---|---|---|---|---|
| 5,529,436 | A | 6/1996 | Meyers | |
| 5,908,266 | A | 6/1999 | Miller | |
| 6,585,449 | B2 * | 7/2003 | Chen | 404/2 |
| 6,746,179 | B1 | 6/2004 | Kerkhoff | |
| 6,869,526 | B2 | 3/2005 | Sharpless | |
| 6,962,463 | B2 | 11/2005 | Chen | |
| 6,962,464 | B1 * | 11/2005 | Chen | 405/43 |
| 7,198,432 | B2 * | 4/2007 | Chen | 405/50 |
| 7,351,004 | B2 * | 4/2008 | Shaw et al. | 404/17 |
| 7,575,394 | B2 * | 8/2009 | Shaw et al. | 404/72 |
| 7,637,694 | B1 | 12/2009 | Musser | |
| 7,637,695 | B1 * | 12/2009 | Akkala | 405/118 |
| 7,651,293 | B2 * | 1/2010 | Shaw et al. | 404/72 |
| 7,699,557 | B2 * | 4/2010 | Shaw et al. | 404/2 |
| 7,946,784 | B2 | 5/2011 | Knak | |
| 7,967,523 | B2 | 6/2011 | Hetzler et al. | |
| 8,162,563 | B2 * | 4/2012 | Shaw et al. | 404/75 |
| 8,240,946 | B2 * | 8/2012 | Applefield | 404/4 |
| 8,469,625 | B2 * | 6/2013 | White | 404/2 |
| 2007/0166105 | A1 | 7/2007 | Rzadkowolski | |
| 2008/0159811 | A1 * | 7/2008 | Shaw et al. | 405/50 |

* cited by examiner

WATER PERMEABLE TRAFFIC BEARING SYSTEM, METHOD AND DRAINAGE JOINT FOR USE WITH SAME

This Application is a Divisional of U.S. patent application Ser. No. 13/206,585, now U.S. Pat. No. 8,469,625, filed Aug. 10, 2011, which claims the benefit of U.S. Provisional Patent Application Nos. 61/480,025, filed Apr. 28, 2011, and 61/372,239, filed Aug. 10, 2010.

TECHNICAL FIELD

The present disclosure relates generally to traffic bearing systems such as driveways, sidewalks, parking lots and roadways, and relates more particularly to an in situ drainage joint for a water-permeable traffic bearing system positionable between water impermeable surface pads.

BACKGROUND

Over many decades, civil engineering endeavors have altered naturally occurring drainage patterns. Transportation and other infrastructure projects are notable examples, typically transforming areas of land from a permeable state capable of absorbing and relatively slowly discharging large volumes of water into impermeable roads, parking lots and the like. Substrates covered over with a layer of concrete or asphalt tend to shed water quite rapidly, causing or exacerbating flooding, and sometimes overloading antiquated wastewater treatment systems in response to precipitation events. In recent years, contractors, engineers and government officials have begun to search for ways to ameliorate undesired effects of certain construction projects on local water drainage and storage capabilities.

One well-known strategy for handling excess water in densely developed regions is the use of retention ponds. It is common for new home construction, particularly in subdivisions, to be accompanied by the creation of man-made retention ponds. Retention ponds create a local storage volume for water which can be released relatively more slowly by evaporation, soil infiltration, etc., than what would occur were precipitation simply allowed to run directly into streams or sewer systems. While relatively simple and straightforward, time and construction expense, as well as safety and even wildlife control issues tend to make retention ponds undesirable in many instances.

Various proposals have also been set forth in relation to pervious construction materials. Concretes, ceramics, and even asphalt paving materials are known which claim to allow water to drain into an underlying substrate. These novel materials may have their place, but are not without drawbacks. On the one hand, construction of traffic bearing surfaces is already a relatively labor intensive process, requiring significant expense. Introducing exotic materials, and often requiring their installation in a fairly precisely prescribed manner and/or under tightly specified environmental conditions, can result in excessive construction costs. On the other hand, such materials may have inherent properties inferior to certain conventional materials such as concrete, asphalt paving material, and brick. There is thus a need for improved strategies to address changes in local water drainage and storage which inevitably result from construction activities.

SUMMARY OF THE DISCLOSURE

In one aspect, a method of making a water permeable traffic bearing system includes preparing a compound water permeable base in contact with a native substrate, and installing a drainage system having a plurality of elongate drainage joints over the prepared water permeable base. Each of the drainage joints includes an upper inlet side, and a lower outlet side contacting the water permeable base, and defines a plurality of vertical drainage conduits opening at each of the upper and lower sides and in fluid communication with a storage volume defined by the water permeable base. The method further includes forming a segmental mat having a plurality of water impermeable surface pads abutting the plurality of drainage joints, at least in part by filling voids extending horizontally between the drainage joints with a curable paving material, and curing the paving material within the voids, in contact with each of the water permeable base and the drainage joints. Installing the drainage system further includes tuning precipitation handling of the traffic bearing system, at least in part by setting a spacing and a number of the drainage joints responsive to, a water throughput factor of the traffic bearing system and a structural factor of the segmental mat.

In another aspect, a water permeable traffic bearing system includes a compound water permeable base including a geotextile fabric contacting a native substrate, a lower aggregate course containing a first type of aggregate material, and an upper aggregate course containing a second type of aggregate material. The lower and upper aggregate courses together define a storage volume of the water permeable traffic bearing system based on void to solid ratios of the first and second types of aggregate. The system further includes a drainage system installed vertically above the water permeable base, and including a plurality of elongate drainage joints arranged in a plurality of horizontally extending drainage joint assemblies contacting the upper aggregate course. Each of the drainage joints includes an upper side, a lower side contacting the upper aggregate course, and defines a plurality of vertical drainage conduits which each include an inlet located in the upper side, an outlet located in the lower side, and being in fluid communication with the storage volume. The system further includes a segmental mat having a plurality of water impermeable surface pads each adjoining at least one of the drainage joints, and including an upper traffic bearing surface and a lower surface in contact with the upper aggregate course. The water permeable base includes a vertically non-uniform porosity, and a number and a spacing of the drainage joints is based at least in part on a water throughput factor of the traffic bearing system and a structural factor of the segmental mat.

In still another aspect, a drainage joint for a traffic bearing system includes an elongate rectangular body positionable between adjacent water impermeable pads of a segmental mat in the traffic bearing system. The elongate rectangular body includes an upper side, a lower side configured to contact a water permeable base extending horizontally under the segmental mat, and defining a longitudinal body axis extending between first and second body ends. The elongate rectangular body further includes a set of upwardly oriented legs, a set of downwardly oriented legs, and a bridge joining the sets of legs in an H-configuration. An inlet channel is defined by the set of upwardly oriented legs and extends axially between the first and second body ends, and an outlet channel is defined by the set of downwardly oriented legs and also extends axially between the first and second body ends. The bridge defines a plurality of vertical drainage conduits fluidly communicating between the inlet channel and the outlet channel, whereby the drainage joint drains water under the force of gravity from traffic bearing surfaces of the water impermeable pads into the water permeable base. The drainage joint further includes a serviceable debris guard positionable within the inlet channel.

DETAILED DESCRIPTION

Figure 1:
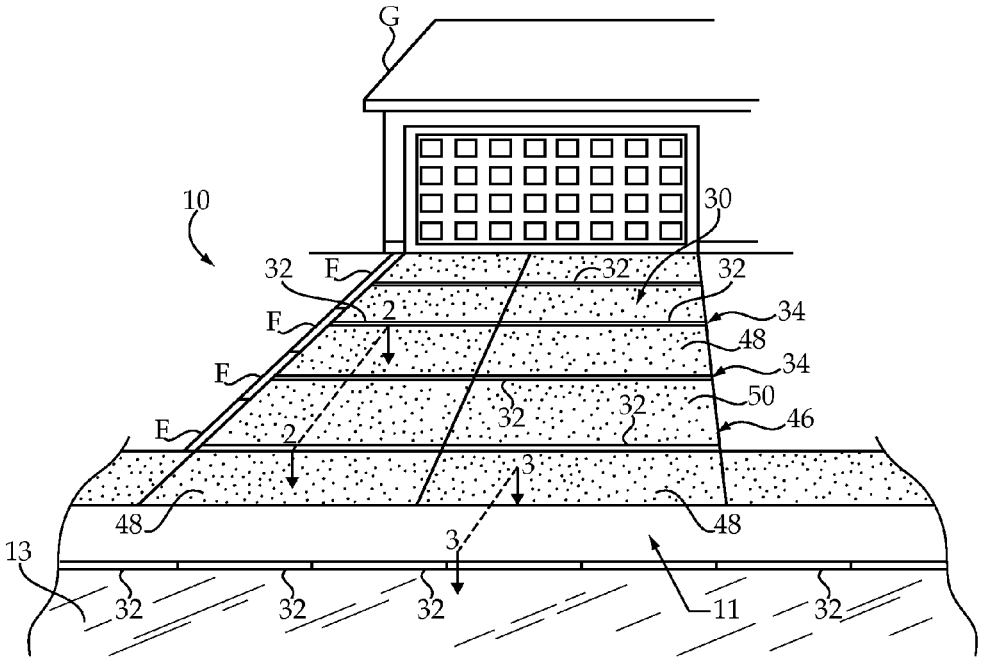
FIG. 1 is a diagrammatic view of a water permeable traffic bearing system according to one embodiment.

Referring to FIG. 1, there is shown a water permeable traffic bearing system 10 according to one embodiment. System 10 is shown in the context of a residential driveway system, however, the present disclosure is not thereby limited and may also be applied to sidewalks, roads, parking lots and essentially any other man made system for bearing pedestrian or vehicular traffic. As will be further apparent from the following description, system 10 may be uniquely configured to enable its water permeability to be tuned in response to various factors.

Figure 2:
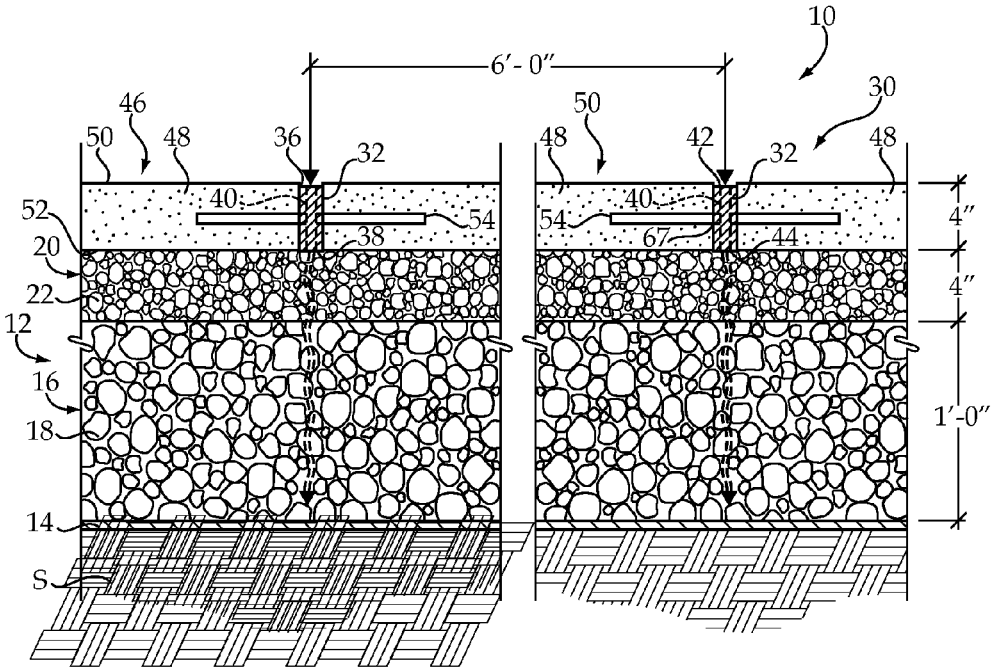
FIG. 2 is a sectioned view taken along line 2-2 of FIG. 1.

Referring also to FIG. 2, there is shown a sectioned view taken along line 2-2 of FIG. 1. System 10 may include a compound water permeable base 12 including a geotextile fabric 14 contacting a native substrate S. Substrate S may include an undisturbed soil substrate, including a sandy soil substrate, a clayey soil substrate, a high organic matter topsoil, or any other native soil, rock, or mixtures thereof. Water permeable base 12 may be understood as compound because it includes a plurality of different prepared courses of material such as aggregate, where each of the different courses has different properties. In one embodiment, base 12 may include a lower aggregate course 16 contacting fabric 14 and containing a first type of aggregate material 18, and an upper aggregate course 20 containing a second type of aggregate material 22. In the illustrated embodiment, aggregate material 18 may include one inch to one and a half inch aggregate, whereas aggregate material 20 may include a three eighths inch aggregate. Lower and upper aggregate courses 16 and 20 together define a water storage volume of system 10 based on void to solid ratios of aggregate types 18 and 22, and of course basic geometry of system 10 such as its horizontal footprint and vertical thickness of each of courses 16 and 20. A storage volume of water within other parts of system 10 such as within drainage joints 32 themselves may also affect the total volume of water which can be stored within system 10, however, in most cases the void to solid ratios of aggregate types 18 and 22, and the vertical thickness and horizontal footprint mentioned above will be predominant factors in determining how much water can be stored at any one time within system 10. Determination and significance of the water storage volume of system 10, and how the water storage volume may be somewhat unpredictable prior to commencing construction, is further described below.

A drainage system 30 is installed vertically above base 12, and includes a plurality of elongate drainage joints 32 arranged in a plurality of horizontally extending drainage joint assemblies 34, contacting upper aggregate course 20. Each of drainage joints 32 includes an upper side 36, a lower side 38 contacting upper aggregate course 20, and defines a plurality of vertical drainage conduits 40 which each include an inlet 42 located in upper side 36 and an outlet 44 located in lower side 38. Each of conduits 40 are in fluid communication with the storage volume defined by aggregate courses 16 and 20, and together define a vertical water flow path into base 12, shown via arrows in FIG. 2.

System 10 may further include a segmental mat 46 having a plurality of water impermeable surface pads 48 each adjoining at least one of drainage joints 32. Pads 48 may each include an upper traffic bearing surface 50, and a lower surface 52 in contact with upper aggregate course 20. Each of pads 48 may be configured such that they are free from contact with adjacent pads 48. Base 12 may include a vertically non-uniform porosity, for example as a result of the different void to solid ratios described above. A number and a spacing of drainage joints 32 may be based at least in part on a water throughput factor of system 10 and a structural factor of segmental mat 46.

Water throughput may be understood as a total volume of water which can flow from the upper surfaces 50 of pads 48, through drainage joints 32, through base 12 and then into native substrate S over a predefined time duration. Various factors bear on what this total volume of water per unit time will actually be, and significant variation can be expected from site to site. One factor includes the total surface area defined by pads 48. Surface area of the upper side 36 of each of joints 32 might also be considered, but may be considered negligible in certain instances. Other factors include a cross sectional flow area defined by conduits 40, and a head loss to be expected in flow pressure of water through conduits 40. Head loss can be determined empirically or calculated by way of known techniques. Still other factors include a head loss to be expected as water flows through base 12 into substrate S, and a surface area of contact between base 12 and substrate S, also susceptible to empirical determination and/or calculation. Soil permeability, often described in the art in terms of a soil infiltration rate, can also affect the water throughput, as can changes in soil permeability from season to season based on varying moisture content or frozen versus thawed state of the soil. Soil infiltration rates for most soils and other substrates encountered in construction projects are available from state and local geological and civil engineering services, or are readily calculable by way of known techniques.

It may thus be appreciated that certain of the factors bearing on the total water throughput may relate to inherent properties of the components used in system 10, such as drainage joints 32. For example, drainage joints having a certain density of conduits 40 of a certain size can, in general, be expected to provide a greater total flow area than comparably sized joints having a lesser density of conduits. Head loss can be expected to be relatively greater with smaller sized conduits, so in some instances, for similar total cross sectional conduit flow area, drainage joints 32 with relatively larger sized conduits can be expected to impart less head loss to water draining therethrough to a native substrate than what would be expected for drainage joints with smaller sized conduits. Such properties inherent to the components may be understood as site-inspecific. Other factors, such as soil permeability, void to solid ratios of aggregates 16 and 20, as well as footprint of system 10 and thickness of base 12, may be understood as site-specific.

The term "water throughput factor" used herein should be understood to include a water volume which is handled by system 10, per unit time, under specified conditions. A first example could be maximum number of cubic feet of water per hour which can fall on the total surface area defined by pads 48 and pass into substrate S, for a given number of hours, without eventually exceeding a storage volume of base 12 and causing overflowing. In this example, assume the total surface area defined by pads 48 is about 400 square feet, typical for a residential driveway. Further assume that the soil infiltration rate for substrate S is equal to about 25 cubic feet per hour for a similar footprint of 400 square feet, although as suggested above this rate may vary widely based on local conditions. Finally, assume also that the total water storage volume of the traffic bearing system is about 150 cubic feet, based on common void to solid ratios of gravel, thickness of the prepared substrate, and storage volume of the drainage joints themselves. A precipitation event delivering about 100 cubic feet per hour, for two hours, can be handled by the subject system. In other words, since about 25 cubic feet per hour may be drained into the soil, water will accumulate in the storage volume roughly at a rate of 75 cubic feet per hour, and it will take about two hours for the storage volume to fill completely, after which point system 10 may cease to drain all of the water falling on mat 46 and some overflowing may occur.

Assume further that historical precipitation records indicate that a precipitation event delivering water at 100 cubic feet per hour, for two consecutive hours, to a traffic bearing system configured in this manner is a two-Sigma event in any one-year period, meaning such an event has a probability based on two or more standard deviations from a mean. If the ability to handle a two-Sigma event is acceptable, then the traffic bearing system 10 may have a number and a spacing of drainage joints 32 set responsive to a water throughput factor of 100 cubic feet per hour, for two hours. If, on the other hand, the ability to handle three-Sigma events is desired, then a number and a spacing of drainage joints 32 may be set responsive to a water throughput factor associated with relatively more intense precipitation events, say, 175 cubic feet per hour, for one hour. In the latter case, the number and spacing of joints 32 may be greater and less, respectively, than in the former case.

A second example might be the maximum number of cubic feet of water per hour which can fall on the total surface area defined by pads 48 and pass into substrate S, without causing overflowing, and when soil moisture content is within one standard deviation of an annual mean. In this second example, the water throughput factor might be 100 cubic feet per hour, for two hours, at a soil moisture content (mass) equal to about 17%, plus or minus 5%. This second example might or might not result in a different number and/or spacing of joints 32 than in the prior examples. In light of these examples, it will be readily apparent that the water throughput factor(s) contemplated herein will typically be more complex than simply a water flow rate. In fact, a system where a water throughput volume per unit time is simply the same as a soil infiltration rate of the native substrate would not fairly be said to be tuned such that a number and/or a spacing of drainage joints is set responsive to a water throughput factor, as that term is intended to be understood. In fact, tuning precipitation handling as contemplated herein will always result in a water throughput volume per unit time which is less than an infiltration rate of the native substrate upon which the corresponding system is installed. How much less will typically depend upon what is considered an acceptably low risk of the system failing to handle precipitation, and resulting in runoff to streams or sewers rather than ultimately draining through the system into the underlying native substrate. Thus, a fairly broad range of different numbers of drainage joints 32, and their relative density and/or arrangement within system 10, is possible based on the desired end goals of the project. As mentioned above, a structural factor of mat 46 may also be a consideration in tuning precipitation handling as described herein.

Historical precipitation event and climatic data are readily publicly available which, in light of the teachings set forth herein, can enable one to design a water permeable traffic bearing system such that precipitation or snowmelt events producing a maximum theoretical water throughput, or some other amount such as a two-Sigma, three-Sigma, etc., event, based on historical data can be readily managed. Thus, setting a number and spacing of drainage joints 32 will also typically include accounting for the likelihood of particular precipitation events actually occurring. In other words, as described herein system 10 need not necessarily be designed to handle precipitation events having long duration and high rainfall or snowmelt intensity levels which are relatively rare, and instead can be designed such that system 10 will sufficiently transit water into substrate S an acceptable proportion of the time.

As mentioned above, a number and a spacing of drainage joints 32 may also be based on a structural factor of segmental mat 46. As further described below, mat 46 may be formed of a curable material such as concrete. Depending upon concrete type, lift thickness, and potentially other factors such as the location of the local frost line, there will often be limitations on the maximum and minimum size which can be practicably used in constructing pads 48. On the one hand, making pads 48 too thin, or too large by way of exposed upper surface area, can create a risk of crack formation in pads 48 in response to thermal changes or freeze-thaw cycles of underlying material. Since mat 46 may be formed without the intentional inclusion of crack arresting surface grooves, the size of pads 48 may be a relatively more important factor than is typically the case with known techniques for forming impermeable traffic bearing surfaces. On the other hand, making pads 48 too small may risk frost heaving and the like, and could also result in pads 48 cracking or being urged out of their intended positioning and alignment in response to traffic loads. Factors expected in an intended service environment, such as maximum load amounts, maximum loading per square inch, loading frequency, and even more complex factors such as acceleration or deceleration loads, may also be or influence structural factors of mat 46. In view of the foregoing description, it will thus be appreciated that a number of different factors may be balanced against one another to tune water handling of system 10.

Another way to understand the above principles, is that while the capacity to handle precipitation via transiting water into substrate S may certainly be increased by increasing a number and/or density of drainage joints 32, a larger number by definition decreases a size of pads 48. Thus, one might be tempted to design system 10 such that it has more than enough capacity to handle even the most extreme precipitation events theoretically occurring at a particular building site. Decreasing size of pads 48, however, can create structural issues as discussed above. A "sweet spot" may be found where joints 32 are sufficient in number to enable more common precipitation or snowmelt events to be handled, without unduly limiting the structural integrity of mat 46. Consideration of the factors described herein enables system 10 to be tuned to local conditions. Since the local conditions are unlikely to be truly known in advance, on-the-spot tunability of system 10 is contemplated to provide significant advantages over both conventional permeable and impermeable traffic bearing systems and strategies for their construction.

In FIG. 1, the plurality of horizontally extending drainage joint assemblies 34 includes a plurality of parallel assemblies 34, which are spaced equally from one another, for example six feet apart center to center. In the illustrated embodiment, segmental mat 46 slopes downwardly from a residential building structure G to an asphalt roadway 13. A rolled concrete curb 11 is positioned between segmental mat 46 and asphalt roadway 13. Each of drainage joint assemblies 34 may extend horizontally across and transverse to the slope, and may be oriented each at a uniform elevation. In other words, drainage joint assemblies 34 may each include their constituent drainage joints 32 at a uniform elevation extending between lateral edges of segmental mat 46. In other embodiments, water throughput and/or structural integrity, or even aesthetic goals could be attained by unequally spacing assemblies 34, or arranging them in a different pattern such as being diagonal to one another.

Figure 3:
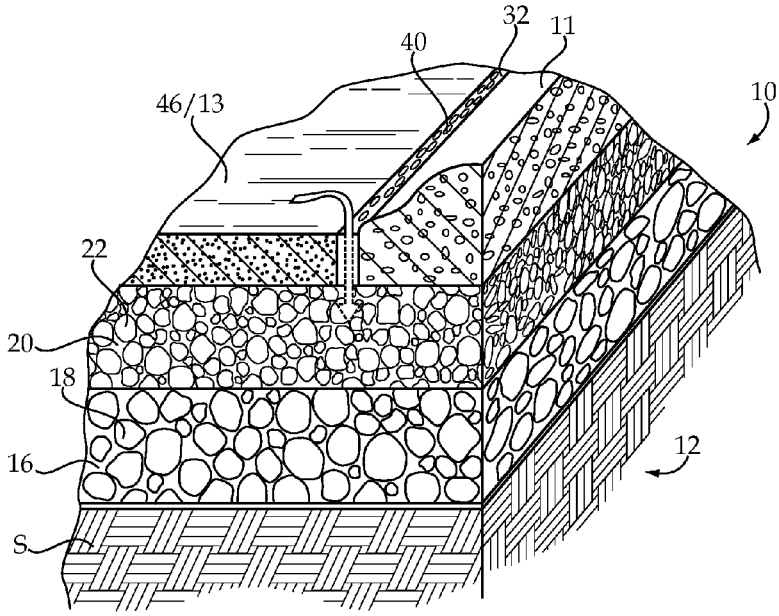
FIG. 3 is a sectioned view taken along line 3-3 of FIG. 1.

In one practical implemental strategy, each of pads 48 may include a cast-in-place concrete pad formed by pouring concrete into voids extending between drainage joint assemblies 34. In a cast-in-place concrete embodiment, rebar members 54 may extend between adjacent pads 48, and may be bonded with concrete forming the adjacent pads 48. Each of rebar members 48 may pass through a through hole 67 formed in each drainage joint 32, and extending between first and second parallel transverse sides thereof, as further described herein. Turning now to FIG. 3, there is shown a sectioned view taken approximately along line 3-3 of FIG. 1, showing a view through rolled curb 11 and asphalt mat 13. System 10 may be constructed such that a driveway portion extends from residential structure G to curb 11, and a roadway structure including asphalt mat 13 extends towards curb 11 from an opposite direction. Drainage joints 32 may be installed within segmental mat 46 of the driveway portion of system 10, whereas one or more joints 32 may also be installed between curb 11 and roadway 13. These different aspects of the presently disclosed concept, a driveway portion versus a roadway edge portion, might also be pursued independently without departing from the scope of the present disclosure. In FIG. 3, an elongate drainage joint 32 is shown installed between curb 11 and asphalt mat 13 and includes a plurality of vertically oriented drainage conduits 40 which define a vertical drainage path from asphalt mat 13 and curb 11 into base 12. As discussed above, the present disclosure is contemplated to be advantageously applied to segmental mat structures. In this vein, asphalt mat 13, rolled curb 11, and pads 48 which are positioned adjacent or adjoining rolled curb 11, may all be considered segments of a mat structure. Similarly, asphalt mat 13 and rolled curb 11 might themselves each be considered "pads" as that term is intended to be understood herein.

Figure 4:
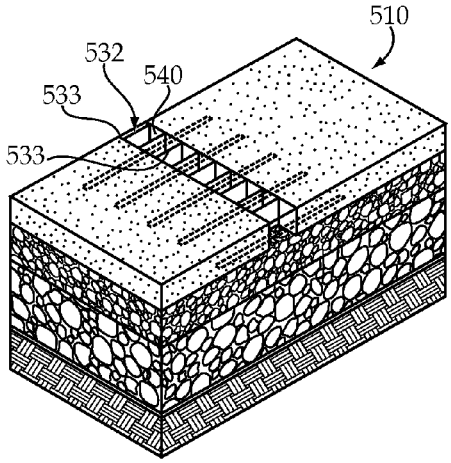
FIG. 4 is a sectioned diagrammatic view of a portion of a water permeable traffic bearing system, according to another embodiment.

Turning now to FIG. 4, there is shown a system 510 according to another embodiment. System 510 includes a plurality of elongate drainage joints 532, one of which is shown, which define a plurality of drainage conduits 540. In particular, drainage joint 532 may include a plurality of separate panels 533 which are either separate components, or formed integrally with a housing structure installed within cast-in-place concrete or another material. System 510 may also include a geotextile fabric, and different aggregate courses, which may be similar or identical to that of system 10 described above.

Figure 5:
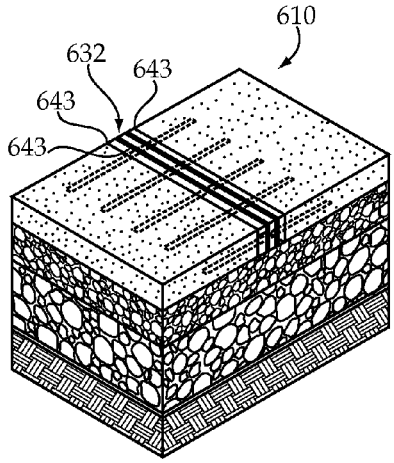
FIG. 5 is a sectioned diagrammatic view of a portion of a water permeable traffic bearing system according to yet another embodiment.

Referring to FIG. 5, there is shown another alternative water permeable traffic bearing system 610 in which a plurality of separate adjacent drainage joints 643 are assembled together to form an elongate drainage joint assembly 632, in which rebar is passed through the multiple different panels. In this embodiment, spacing between the individual joints 643 within assembly 632 may be zero, and other single, or multi panel drainage joint assemblies (not shown) may be positioned at locations spaced from assembly 632.

Figure 8:
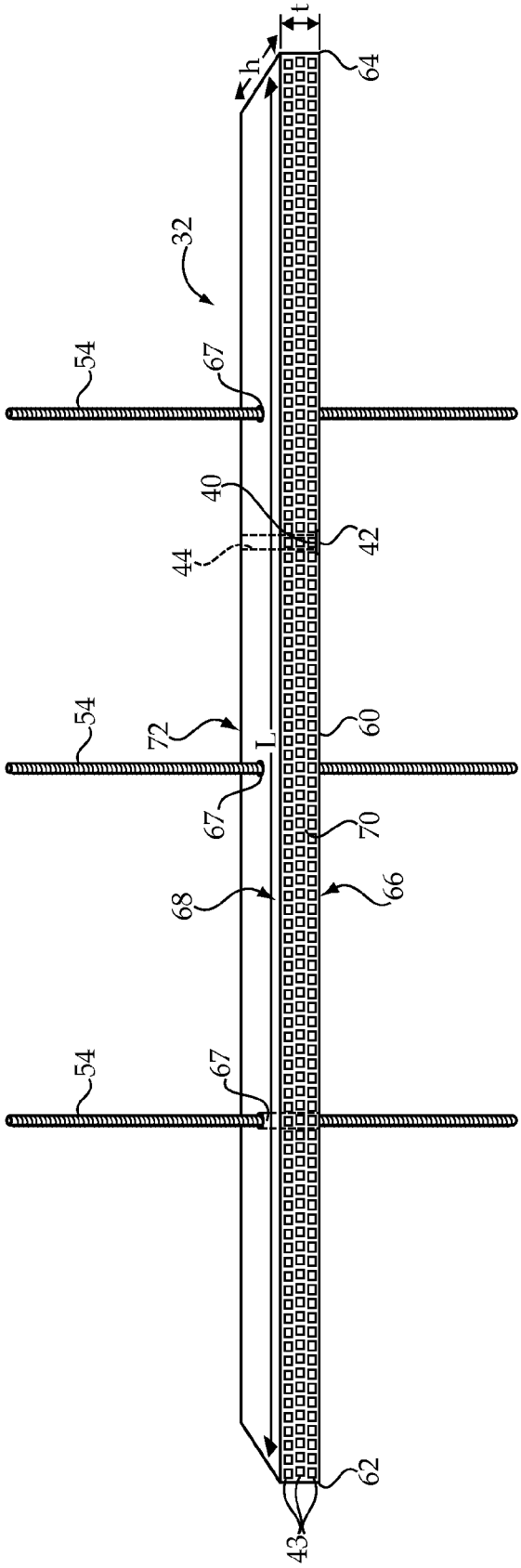
FIG. 8 is a perspective view of an elongate drainage joint according to another embodiment.

Referring now to FIG. 8, there is shown an elongate drainage joint 32 suitable for use in the system of FIG. 1, as well as other embodiments contemplated herein. Drainage joint 32 includes an elongate drainage joint body 60 comprised of a plurality of separate panels 43 sandwiched together. Panels 43 may be attached to one another via any suitable adhesive or fastener system, and in one embodiment each of panels 43 may include a plastic sheet glued to adjacent panels 43 with an epoxy or the like. Each of panels 43 might be formed via extrusion. In one embodiment, a base extrusion might be formed which is cut, scored laterally, or perforated, to enable multiple individual drainage joint panels 43 to be broken off from the base extrusion, as needed at a job site. Body 60 might also be formed as one integral piece. Body 60 may further include a generally rectangular configuration, and having a length dimension L extending from a first body end 62 to a second body end 64. In one embodiment, length dimension L may be equal to about six feet, such that two of bodies 60 positioned end to end can form a twelve foot wide drainage joint assembly. A height dimension h which corresponds to a vertical height of joint 32 when installed for service in a traffic bearing system is oriented perpendicular to length dimension L, and may be equal to about four inches. A thickness dimension t is oriented perpendicular to both length dimension L and height dimension h, and may be equal to between about one and one quarter inches and about one and one half inches. Other embodiments may certainly include variation from the above dimensions.

Each of panels 43 may define drainage conduits 40, and may include a finite number of drainage conduits 40 which is about twenty five, or greater. A number of drainage conduits 40 within each panel 43 may also be greater than fifty, or even greater than one hundred in certain embodiments. A plurality of through holes 67 are shown communicating between a first transverse side 66 and a second transverse side 68 of body 60, and have rebar members 54 positioned therein. Through holes 67 may be spaced equally from one another between ends 62 and 64. Drainage conduits 40 may extend between an upper side 70 and a lower side 72 of body 60. In the embodiment shown in FIG. 8, each of drainage conduits 40 includes a tubular conduit which extends all the way through body 60 between a corresponding inlet 42 and outlet 44, and includes a square conduit cross sectional shape.

Figure 7:
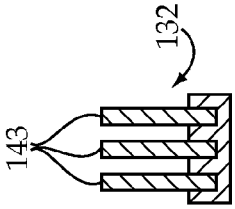
FIG. 7 is a sectioned view taken along line 7-7 of FIG. 6.
Figure 6:
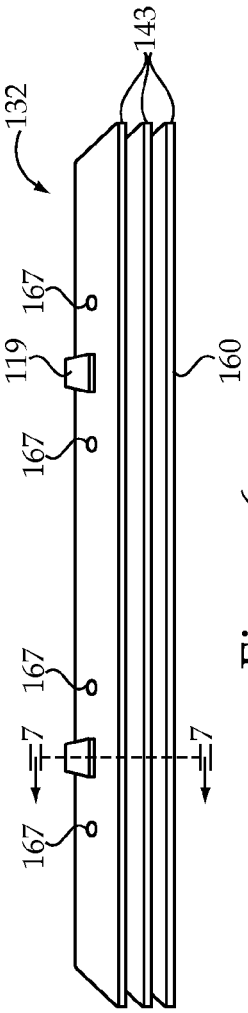
FIG. 6 is a perspective view of an elongate drainage joint according to one embodiment.

Turning now to FIG. 6, there is shown a drainage joint 132 according to another embodiment. Drainage joint 132 may be comprised of a plurality of panels 143, which may include solid molded or extruded plastic panels or metallic panels, each defining through holes 167 for receipt of rebar members. Referring also to FIG. 7, each of panels 143 may be supported in a holder 119 which allows the panels to be arranged within a drainage system and supported in place prior to forming an associated segmental mat, such as by pouring concrete into contact with panels 143.

Figure 9:
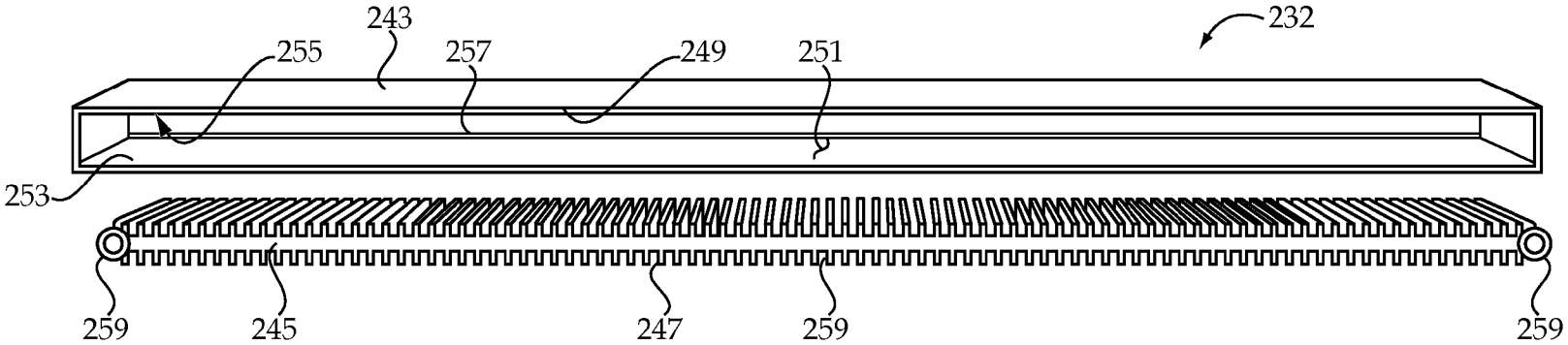
FIG. 9 is a perspective view of a disassembled elongate drainage joint according to yet another embodiment.
Figure 10:
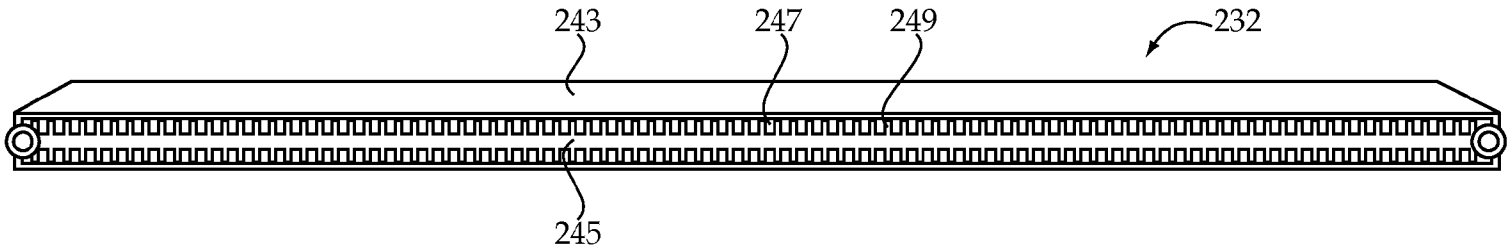
FIG. 10 is an assembled view of the elongate drainage joint of FIG. 9.

Referring now to FIGS. 9 and 10 there is shown yet another drainage joint embodiment 232 which includes an assembly of a housing 243 and a water channeling member 245. Housing 243 may include an inner housing wall 249 defining a receptacle 251 which receives water channeling member 245 therein. Housing 243 may be configured to remain resident within a traffic bearing structure such as a segmental mat as described herein, and contacting a total of two of the surface pads thereof. Water channeling member 245 may be removable for cleaning or other maintenance purposes, and to this end might be equipped with a set of lifting eyes 259 which allow maintenance personnel to lift water channeling member 245 out of housing 243 by way of an open upper side 253. To enable water to flow through joint 232, housing 243 may also include an open lower side 255, but may be equipped with a retaining mechanism such as a ledge 257 upon which water channeling member 245 is positioned and supported within housing 243.

FIG. 10 illustrates water channeling member 245 positioned within housing 243. In one embodiment, each of housing 243 and water channeling member 245 may include cast components, such as cast iron components. Water channeling member 245 may also include a plurality of cast or machined fins 247 which define a plurality of drainage conduits 249.

Figure 11:
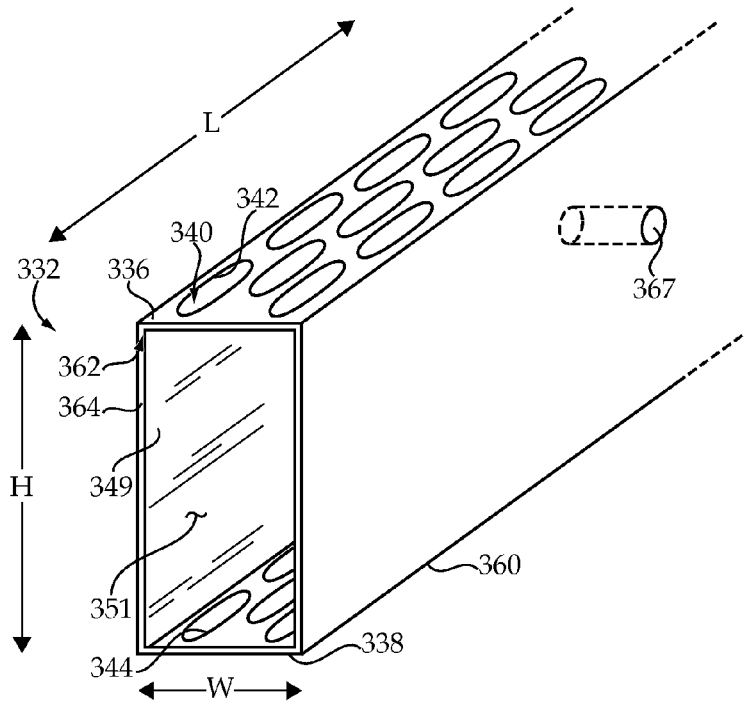
FIG. 11 is a diagrammatic view of a portion of an elongate drainage joint according to yet another embodiment.

Turning now to FIG. 11, there is shown an elongate drainage joint 332 according to yet another embodiment. Drainage joint 332 may have certain similarities with foregoing embodiments described herein, but also certain differences. Among these differences, joint 332 may be comprised of a hollow body 360 which includes an elongate rectangular hollow body having an end 362, and an opposite end which is not visible in FIG. 11. A plurality of drainage conduits 340 may be formed in an upper side 336 of joint 332, and may include an inlet 342 and an outlet 344 in lower side 338. Drainage conduits 340 may connect with one another within the hollow interior of drainage joint 332, in contrast to certain of the foregoing embodiments. Joint 332 may also include a wall 364 having a uniform thickness on all sides of drainage joint 332, which is equal to about one eighth of an inch in one embodiment, but could be thinner or thicker. Wall 364 may include an inner surface 349 which defines a central cavity 351. A through hole 367 may extend between transverse sides of joint 332 for receipt of a rebar member or the like. Additional through holes may be formed in drainage joint 332, but are not visible in FIG. 4. Drainage joint 332 may also include a length L, a height H and a width W, similarly dimensioned and proportioned to that of the embodiment described above in connection with FIG. 8. In one embodiment, drainage joint 332 may be formed via injection molding or extrusion, of aluminum or a plastic material, and conduits 340 may be formed in the resulting molded body via water jet or laser machining, or by any other suitable process.

Figure 12:
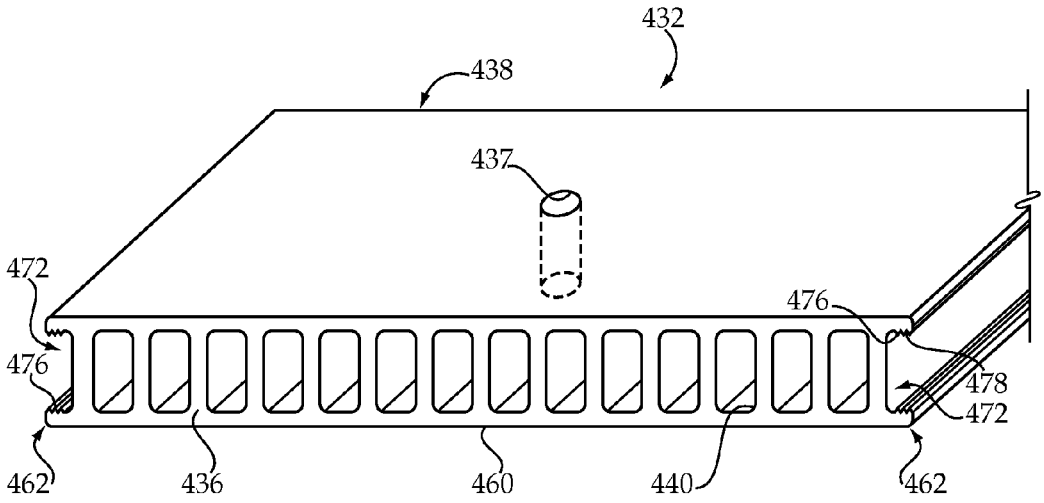
FIG. 12 is a diagrammatic view of an elongate drainage joint according to yet another embodiment.

Turning now to FIG. 12, there is shown yet another embodiment of a drainage joint 432 according to the present disclosure. Drainage joint 432 may include an elongate body 460 extending between a first end and a second end, each labeled with reference numeral 462. A through hole 437 may communicate between transverse sides of elongate body 460. A plurality of drainage conduits 440 may extend completely through body 460, from an inlet side 436, to an outlet side 438. Each of ends 462 may include an end connector 472. End connectors 472 may be configured to enable body 460 to be coupled with an adjacent drainage joint body, not shown in FIG. 12. In one embodiment, drainage joint 432 may be assembled with other drainage joints within a drainage joint assembly similar to that described above, such that end connectors are used to couple together adjacent ones of the drainage joint bodies 432. To this end, while drainage joint 432 is shown in the context of having two female-type end connectors, adjacent drainage joint bodies might be equipped with complementary male connectors. In the embodiment shown, end connectors 472 each include a plurality of teeth 476 alternating with a plurality of grooves 478, configured to engage with complementary teeth and grooves of an adjacent drainage joint. However, it should be appreciated that alternative male/female coupling strategies might be used, an adhesive, or simply fasteners such as pins, bolts, screws, or nails. Further, rather than two different types of drainage joints, one having female end connectors and the other type having male connectors, each body 460 within a drainage joint assembly might include both of a female end connector and a male end connector.

Figure 14:
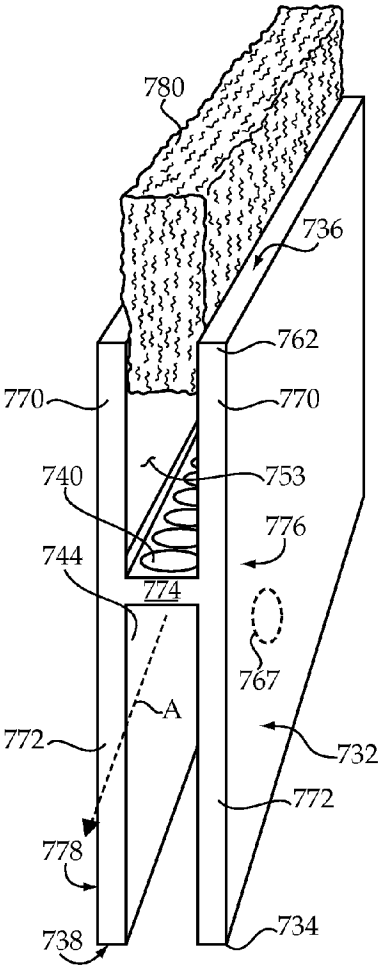
FIG. 14 is an end view of an elongate drainage joint, as used in the embodiment of FIG. 13.
Figure 13:
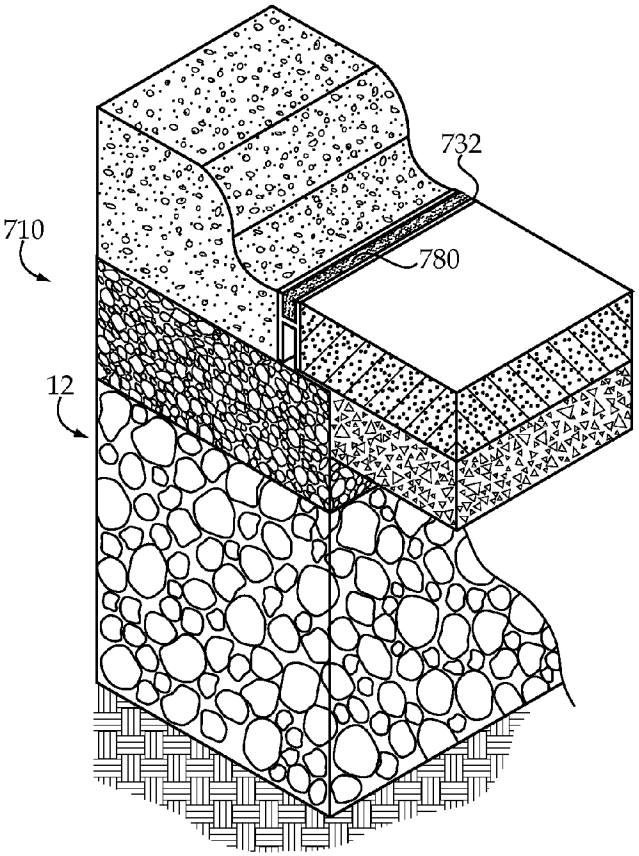
FIG. 13 is a sectioned view of a traffic bearing system according to yet another embodiment.

Turning now to FIGS. 13 and 14, there is shown yet another embodiment of a drainage joint 732 according to the present disclosure. Drainage joint 732 may include an elongate rectangular body 734 positionable between adjacent water impermeable pads of a segmental mat in a traffic bearing system 710. Body 732 includes an upper side 736, a lower side 738 configured to contact a water permeable base extending horizontally under the segmental mat, and the body defines a longitudinal body axis A extending between a first body end 762, and an opposite second body end. Body 732 further includes a set of upwardly oriented parallel legs 770, a set of downwardly oriented parallel legs 772, and a bridge 774 joining the sets of parallel legs in an H-configuration. In the illustrated embodiment, drainage joint 732 includes a total of two upwardly oriented parallel legs, and a total of two downwardly oriented parallel legs, although a greater number of legs in the respective sets might be used without departing from the present disclosure. In one embodiment, body 734 may include a one-piece body, and may comprise an extrusion consisting essentially of aluminum. Other materials such as composites, plastics, or mixtures thereof, as well as various recycled materials might also be used.

Drainage joint 732 may be implemented in a manner similar to any of the other drainage joint embodiments described herein. To this end, an inlet channel 743 is defined by upwardly oriented legs 770 and extends axially between the first and second body ends. An outlet channel 744 is defined by downwardly oriented parallel legs 772 and also extends axially between the first and second body ends. Bridge 774 defines a plurality of vertical drainage conduits 740 fluidly communicating between inlet channel 743 and outlet channel 744 such that water drains under the force of gravity from traffic bearing surfaces of the associated water impermeable pads and into the underlying water permeable base conduits 740 may thus be understood to extend from first side 736 to second side 738. Body 734 further includes a first rectangular outer face 776, and a second, opposite rectangular outer face 778. Each of faces 776 and 778 may be planar, or at least substantially so. The respective rectangular outer faces may each be located in part upon one of upwardly oriented legs 770 and in part upon one of downwardly oriented legs 772. A plurality of through-holes, one of which is shown and identified via reference numeral 767 are positioned vertically below bridge 774 and communicate horizontally between first and second faces 776 and 778, for positioning rebar through drainage joint 732 and within adjacent water impermeable pads. In one embodiment, through-holes 767 may be positioned approximately equidistant between upper side 736 and lower side 738, and bridge 774 may be vertically offset from longitudinal axis A such that a vertical length of downwardly oriented legs 772 is greater than a vertical length of upwardly oriented legs 770. By vertically offsetting bridge 774, through-holes 767 may be positioned halfway between upper and lower sides 736 and 734 such that it is unnecessary to position through-holes 767 either passing through bridge 774 or vertically offset from axis A. Axis A may be located half way vertically between top and bottom edges of body 734, and intersected by center axes of each of conduits 740.

Joint 732 may further include a serviceable debris guard 780 positionable within inlet channel 743. Debris guard 780 serves the purposes of providing an aesthetically attractive visible portion of joint 732 when placed in service, and also preventing debris from entering into and clogging drainage conduits 740 or otherwise becoming lodged within joint 732 or the underlying water permeable base. Serviceable debris guard 780 may further include a rectangular configuration and may be removable from inlet channel 743, such that it may be cleaned of debris and replaced. In one embodiment, debris guard 780 may be formed of a fibrous material such as a polypropylene material, however, alternatives are contemplated such as a variety of open cell foams, metallic wools, meshes and the like. Should debris guard 780 become clogged with material such that water drainage through joint 732 becomes less than desired, a replacement debris guard may be swapped for debris guard 780.

The embodiment of FIG. 14 shares certain features and functionality with the previously described embodiments, and is also contemplated to be particularly advantageous from the standpoint of manufacturing. Joint 732 may be formed having any suitable length between its respective body ends, and in one embodiment may be provided in standard six foot lengths. Drainage conduits 740 may be formed in bridge 774 after making the extrusion comprising body 734. In one version, conduit 740 and other pertinent features of joint 732 may be configured such that a flow rate of about two gallons every fifty seconds, per one foot axial length of body 734, where water is draining under the force of gravity, is obtained.

One further concept contemplated herein, using drainage joint 432 or any of the other drainage joint embodiments described, includes a plurality of drainage joints packaged together. Ten, twenty, or even fifty or more individual drainage joints may be palletized and wrapped, or packaged in some other suitable manner, and construction personnel can simply pull individual drainage joints from the package as needed. In one version of this concept, the package of drainage joints includes drainage joints having a uniform size and shape, which can be assembled together in the manner described herein. In another version, the packaged drainage joints may include non-uniform sizes and/or shapes, such that individual joints may be selected to suit a particular project based on their particular size and/or shape. For instance, certain traffic bearing structures may include non-uniform widths or lengths, and a variety of different length drainage joints may be advantageous to enable personnel to adapt different drainage joint assemblies to have different widths, at different locations along a length of the traffic bearing structure.

INDUSTRIAL APPLICABILITY

As discussed above, those skilled in the art will be familiar with the varying availability of certain types of aggregate materials used in construction, depending upon locality. In some regions, stream gravel or the like may be readily available from local sources. In others regions, crushed stone may be the norm. In planning and executing a given construction project, economic and practical feasibility may depend upon the types of materials locally, or semi-locally available. For this reason, the properties of readily available materials such as aggregate used in constructing base 12 may vary from place to place. One property of interest in the context of the present disclosure relates to the void to solid ratio of a particular type of aggregate. While it may be known, say, what void to soil ratio is typically associated with number "X" crushed stone of type "Y", the potential total water storage volume of multiple courses of aggregate materials as described herein will not be typically determinable until the exact types of stone to be used, based in part on local availability, are determined. In a related vein, while a generalized geometry for base 12 may be planned, such as minimum thickness requirements and number of courses, factors like the existence of subsurface aberrations can cause construction plans to be modified. Further still, there may be such a wide variety in preferences and landowner expectations for curving driveways, non-uniform width driveways, and differing slopes, for instance, that the final storage volume of a traffic bearing system may not be readily ascertainable until construction has begun, or just before. The present disclosure allows a permeable traffic bearing system to be tuned to perform according to a contractor, landowner or supervisor's instructions or expectations, or based on legislated requirements, for example.

Referring to the drawings generally, but now in particular to FIGS. 1, 2 and 3, making water permeable traffic bearing system 10 may include preparing compound base 12, in a manner similar to that described above by placing first and second aggregate courses 16 and 20. It may generally be expected that excavation may be necessary to prepare for placement of aggregate courses 16 and 20. Accordingly, in the FIGS. 1 and 2 embodiment aggregate courses 16 and 20 may both be positioned within a trench or the like, extending below a surface of the ground.

Once compound base 12 has been placed, drainage system 30 may be installed thereon such that drainage joints 32 are each positioned in contact with upper aggregate course 20. Both a spacing and a number of drainage joints 32 within system 30 may be based on a water throughput factor of traffic bearing system 10, and a structural factor of mat 46. In particular, tuning precipitation handling of system 10 may include setting a spacing and a number of drainage joints 32 responsive to the water throughput factor and the structural factor, each of which may be determined once the planned composition and geometry of system 10, as well as possibly other factors such as the presence of subsurface aberrations such as a large impermeable rock, are known.

With drainage system 10 installed as described herein, mat 46 may be formed at least in part by filling voids extending horizontally between drainage joints 32 with a curable paving material, and curing the paving material within the voids in contact with base 12 and drainage joints 32. The term "curable paving material" should be understood to refer without limitation to asphalt and concrete paving materials which are cured in ambient air. The presently described systems could also be used for more exotic materials, such as certain concrete materials which are compacted prior to or as part of the curing process.

Prior to or as part of completing the curing and finishing processes of mat 46, upper surface 50 of pads 48 may be smoothed via conventional techniques, and a sealer or other surfacing material may be applied. Once curing is sufficiently complete, a plurality of forms f, arranged along edges of joint assemblies 34 and oriented orthogonal to joints 32, may be removed in a conventional manner. In the illustrated embodiment, forms f are shown only along one lateral side of mat 46, but of course would likely be used on the opposite lateral side.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. For instance, while the various drainage joint embodiments described herein are illustrated as generally linear, curving, sigmoid, and angular drainage joints may still fall within the context of the present disclosure. Other aspects, features and advantages will be apparent upon an examination of the attached drawings and appended claims.

What is claimed is:

1. A method of making a water permeable traffic bearing system comprising the steps of:

preparing a compound water permeable base in contact with a native substrate;

installing a drainage system having a plurality of elongate drainage joints over the prepared water permeable base, each of the drainage joints including an upper inlet side, and a lower outlet side contacting the water permeable base, and defining a plurality of vertical drainage conduits opening at each of the upper and lower sides and in fluid communication with a storage volume defined by the water permeable base; and forming a segmental mat having a plurality of water impermeable surface pads abutting the plurality of drainage joints, at least in part by filling voids extending horizontally between the drainage joints with a curable paving material, and curing the paving material within the voids, in contact with each of the water permeable base and the drainage joints;

wherein the step of installing further includes tuning precipitation handling of the traffic bearing system, at least in part by setting a spacing and a number of the drainage joints responsive to, a water throughput factor of the traffic bearing system and a structural factor of the segmental mat;

wherein tuning precipitation handling further includes balancing the water throughput factor with the structural factor, and the water throughput factor including a limit on transiting water through the system without overflowing and being based upon a water storage volume of the water permeable base and a water infiltration rate of the native substrate;

wherein the step of preparing further includes placing a geotextile fabric in contact with the native substrate, placing a lower course of a large aggregate material over the geotextile fabric, and placing an upper course of a small aggregate material over the lower course, and wherein the water storage volume is defined by a void to solid ratio of each of the lower and upper courses;

wherein the step of forming further includes passing rebar through apertures communicating between transverse sides of each one of the drainage joints, and filling the voids with poured concrete after passing rebar through the apertures to form the plurality of water impermeable surface pads.

2. The method of claim 1 further including a step of inhibiting cracking of the water impermeable pads by way of tuning precipitation handling.

3. The method of claim 1 wherein the step of installing further includes aligning a plurality of the drainage joints end to end, in each of a plurality of parallel drainage joint assemblies, and where each of the plurality of drainage joints includes a set of upwardly oriented legs, a set of downwardly oriented legs, and a bridge joining the sets of legs in an H-configuration.

4. A method of making a water permeable traffic bearing system comprising the steps of:

preparing a compound water permeable base in contact with a native substrate;

installing a drainage system having a plurality of elongate drainage joints over the prepared water permeable base, each of the drainage joints including an upper inlet side, and a lower outlet side contacting the water permeable base, and defining a plurality of vertical drainage conduits opening at each of the upper and lower sides and in fluid communication with a storage volume defined by the water permeable base; and forming a segmental mat having a plurality of water impermeable surface pads abutting the plurality of drainage joints, at least in part by filling voids extending horizontally between the drainage joints with a curable paving material, and curing the paving material within the voids, in contact with each of the water permeable base and the drainage joints;

wherein the step of installing further includes tuning precipitation handling of the traffic bearing system, at least in part by setting a spacing and a number of the drainage joints responsive to, a water throughput factor of the traffic bearing system and a structural factor of the segmental mat, where the water throughput factor includes a limit on transiting water through the system without overflowing and being based upon a water storage volume of the water permeable base and a water infiltration rate of the native substrate; and wherein the step of forming further includes passing rebar through apertures communicating between transverse sides of each one of the drainage joints, and filling the voids with poured concrete after passing rebar through the apertures to form the plurality of water impermeable surface pads.

* * * * *